US007857964B2

(12) United States Patent
Mashiko et al.

(10) Patent No.: US 7,857,964 B2
(45) Date of Patent: Dec. 28, 2010

(54) METHOD OF REFINING HEAVY OIL AND REFINING APPARATUS

(75) Inventors: Yoshinori Mashiko, Yokohama (JP); Akira Sugimoto, Yokohama (JP); Tsuyoshi Okada, Yokohama (JP)

(73) Assignee: JGC Corporation, Tokyo (JP)

( * ) Notice: Subject to any disclaimer, the term of this patent is extended or adjusted under 35 U.S.C. 154(b) by 355 days.

(21) Appl. No.: 10/468,508

(22) PCT Filed: Feb. 19, 2002

(86) PCT No.: PCT/JP02/01420

§ 371 (c)(1),
(2), (4) Date: Aug. 18, 2003

(87) PCT Pub. No.: WO02/066583

PCT Pub. Date: Aug. 29, 2002

(65) Prior Publication Data

US 2004/0084351 A1 May 6, 2004

(30) Foreign Application Priority Data

Feb. 20, 2001 (JP) ..... 2001-044036

(51) Int. Cl.
*C10G 67/04* (2006.01)
*B01D 11/00* (2006.01)

(52) U.S. Cl. ..... 208/211; 208/36; 208/86; 208/210; 208/311; 208/DIG. 1; 196/14.52; 250/339.09; 250/339.12; 250/341.5

(58) Field of Classification Search ..... 196/14.52; 208/36, 38, 210, 211, 311, DIG. 1; 250/339.09, 250/339.12, 341.5
See application file for complete search history.

(56) References Cited

U.S. PATENT DOCUMENTS 2,925,374 A * 2/1960 Gilmore et al. ..... 208/86
3,392,112 A * 7/1968 Bercik et al. ..... 208/210
3,403,092 A * 9/1968 Rausch ..... 208/36

(Continued)

FOREIGN PATENT DOCUMENTS

CA 1 246 482 A1 12/1988

(Continued)

OTHER PUBLICATIONS

Nomura et al., Hydrotreating of Petroleum Deasphalted Oils from Thermal Cracking Residue and of a Benzene-Soluble Fraction from SRC—Hydrocracking Behavior of the Asphaltene and Polar Compound Fractions—, Journal of the Japan Petroleum institute, 1988, vol. 31, No. 6, pp. 473-477.

(Continued)

*Primary Examiner*—Prem C Singh
(74) *Attorney, Agent, or Firm*—Leason Ellis LLP.

(57) ABSTRACT

The present invention relates to a method in which grades of oil are refined according to their object from a feed oil. This method has a solvent extraction process that obtains an extracted oil, and a hydrogenation process that subjects the obtained extracted oil to hydrogenation process in the presence of hydrogen and a catalyst to obtain a hydrorefined oil. The solvent extraction conditions are selected by using the poly-aromatic concentration as an index for calculating the concentration of heptane insoluble components in the residue of the extracted oil obtained by the solvent extraction process that cannot be fractionally distilled.

7 Claims, 10 Drawing Sheets

U.S. PATENT DOCUMENTS

| | | | | |
|---|---|---|---|---|
| 3,714,025 | A | 1/1973 | Aigenson et al. | |
| 3,775,292 | A | 11/1973 | Watkins | |
| 4,244,808 | A | 1/1981 | Lang et al. | |
| 4,548,711 | A | 10/1985 | Coombs et al. | |
| 5,076,909 | A | 12/1991 | Overfield et al. | |
| 5,763,883 | A * | 6/1998 | Descales et al. | 250/339.09 |

FOREIGN PATENT DOCUMENTS

| | | | |
|---|---|---|---|
| DE | 28 40 986 | A1 | 4/1980 |
| DE | 3444721 | A1 | 6/1985 |
| EP | 0 933 418 | A2 | 8/1999 |
| FR | 2 436 811 | A1 | 9/1979 |
| FR | 2 556 361 | A1 | 6/1985 |
| JP | 50-107003 | A1 | 8/1975 |
| JP | 51-87506 | A1 | 7/1976 |
| JP | 55-89391 | A1 | 7/1980 |
| JP | 59-27986 | A1 | 2/1984 |
| JP | 60-186590 | A1 | 9/1985 |
| JP | 11-80755 | A1 | 3/1999 |
| JP | 2000-80208 | A1 | 3/2000 |

OTHER PUBLICATIONS

Japanese Office Action mailed Sep. 21, 2010 for the corresponding Japanese Application No. 2001- 044036.

* cited by examiner

METHOD OF REFINING HEAVY OIL AND REFINING APPARATUS

FIELD OF THE INVENTION

The present invention relates to method and facility for refining heavy oil wherein the conditions of the hydrogenation process that become severe due to impurities in the crude oil source can be improved, and thereby the hydrogenation process can be carried out under mild conditions.

BACKGROUND ART

Many impurities are present in the oil fractions and the oil residue obtained from the crude oil that serves as the starting material. Therefore, in the hydrogenation process that is normally carried out as a later process on these oil fractions and oil residue, currently, hydrorefining is carried out under severe reactive conditions at high temperature and high pressure in order to eliminate these impurities, and thereby a large amount of catalyst is consumed.

However, when carrying out this hydrogenation process under severe conditions, naturally there are the drawbacks that a great deal time and cost are involved in the maintenance of this process unit and that the catalyst life of the process is short. In addition, it becomes difficult to produce flexibly various types of oil products according to their objective.

In consideration of the circumstances described above, it is an object of the present invention to provide a heavy oil refining method and a heavy oil refining facility wherein the hydrogenation process can be carried out under comparatively mild conditions, and thereby, various types of oil products according to their objective and intermediate oil products can be flexibly produced.

SUMMARY OF THE INVENTION

As a result of intensive investigations carried out to solve this problem, it has been discovered that by focusing on the fraction that cannot be fractionally distilled in the extracted oil obtained by the solvent extraction generally carried out in the early stages of hydrogenation process, and after having established this as a target, by selecting the extraction conditions in a solvent extraction process, the subsequent hydrogenation process can be carried out stably and under mild conditions.

A first aspect of the present invention is a refining method for refining heavy oil and obtaining refined oil, and this method comprises a solvent extraction process in which an extracted oil is obtained by a solvent extraction process, and a hydrorefining process in which the refined oil is obtained by hydrogenating the obtained extracted oil in the presence of hydrogen and a catalyst; and further comprises the steps of detecting the specific component concentrations in the extracted oil obtained by the solvent extraction process and controlling the extraction conditions depending on these detected values.

Generally, in the extracted oil obtained by the solvent extraction process, in addition to hydrocarbons, there is residual sulfur, nitrogen, oxygen, nickel, vanadium, and the like. In order to eliminate these residual components to obtain various types of oil products and intermediate oil products, the extracted oil further undergoes a hydrogenation process.

Thus, the residual components in the extracted oil, that is, the residual components described above that cannot be fractionally distilled, were investigated by carrying out the following type of experiments.

First, the following shows the five types of feed oil used in the experiment.

| | SL-VR | DURI-VR | MR-VR | AL-VR | ALH-VR |
|---|---|---|---|---|---|
| Specific gravity (15/4° C.) | 0.952 | 0.958 | 1.007 | 1.017 | 1.032 |
| Viscosity at 210° C. (cST) | 80 | 130 | 649 | 1585 | 4327 |
| Ni/V (ppm) | 29/0 | 47/0 | 43/0 | 26/90 | 35/143 |
| Sulfur (wt %) | 0.19 | 0.26 | 3.5 | 4.3 | 4.91 |
| Asphaltene (wt %) | 0.2 | 2.1 | 6.8 | 8.1 | 11.7 |
| Nitrogen (wt %) | 0.35 | 0.57 | — | — | — |

Here, SL-VR denotes Sumatra Light-Vacuum Residue, DURI-VR denotes Duri-Vacuum Residue, MR-VR denotes Murban-Vacuum Residue, AL-VR denotes Arabian Light-Vacuum Residue, and ALH-VR denotes Arabian Light Vacuum Residue Arabian Heavy Vacuum Residue (60, 40 mixed).

In addition, asphaltene is heptane insoluble (C7-insoluble, below abbreviated "C7Insol").

In addition, FIG. 3 shows the relationship between the type of the extraction solvent (the carbon number of the solvent) and the yield (extraction rate) of the deasphalted oil in the case that the solvent extraction process was carried out using the vacuum residue of Arabian Light as a feed oil. The solvents denoted by Cn (where n is 2 to 6) are linear saturated hydrocarbons (alkanes) having n carbon atoms.

As shown in FIG. 3, it can be confirmed that the higher the carbon number, the higher the yield (extraction rate) of the deasphalted oil.

Next, the solvent extraction process is carried out for each of the vacuum residues of the five types of feed oil described above, and the residual rates of each of the impurities in the deasphalted oil (extracted oil) for the yield (extraction rate) of the deasphalted oil were found. The average characteristics of this feed oil is shown in FIG. 4. Moreover, in FIG. 4, S denotes the sulfur that is an impurity, N similarly is nitrogen, C denotes Conradson carbon residue, Ni denotes Nickel, and V denotes vanadium. In addition, the diagonal line in FIG. 4 denotes that no selection of any kind was made for the extraction rate, and is a line signifying that when the extraction rate is high, the impurities described above were uniformly extracted depending on the extraction rate.

According to the results shown in FIG. 4, although the residual rate of the impurities increases along with the rise in the deasphalted oil yield (extraction rate), their respective selectivities can be known based on the curve for each impurity, which is lower than this diagonal. In particular, for Ni and V, it is understood that when the extraction rate exceeds 60%, the rate at which these impurities remain in the extracted oil side becomes high. Therefore, when the extraction rate in the solvent extraction process is made too high, in particular, the residual rates of the Ni and V rapidly increase, which adds a large burden to the hydrogenation process in the later stages. As a result, because severe process conditions must become used, normally the solvent extraction process is carried out such that the range of the extraction rate is 60 to 85%.

Moreover, in the cases of Ni and V, when the extraction rate is less than 60%, although practically none remains in the extracted oil, sulfur and nitrogen do not have as much selectivity as Ni and V, and therefore, because a great deal remains a hydrogenation process is necessary at a later stage, even when the extraction rate is less than 60%.

In addition, as shown in FIG. 3, the extraction rate by the solvent extraction process changes depending on the type of solvent. However, in addition to the type of solvent, it can also be changed due to such operating factors (control factors) as the extraction temperature and the rate of flow of the solvent. For example, as shown in FIG. 5, by changing the extraction temperature (the process temperature of the extraction process), the yield of the deasphalted oil (extracted oil) can be changed. That is, according to FIG. 5, it can be understood that the extraction rate can be lowered by raising the extraction temperature. Moreover, as extraction conditions for the solvent extraction process shown in FIG. 5, the feed oil was SL-VR, the pressure was 35 kg/cm$^2$G, and the solvent was a butane mixture. In addition, for the rate of flow of the solvent, the weight ratio of the solvent/to the supplied oil was 6.

In addition, as shown in FIG. 6, the yield of deasphalted oil (extracted oil) can also be changed by changing the rate of flow of solvent (the weight ratio of the solvent/supplied oil). That is, according to FIG. 6, it can be understood that by raising the rate of flow of solvent, the extraction rate can be lowered. Moreover, as extraction conditions for the solvent extraction process shown in FIG. 6, the feed oil was DURI-VR, the pressure was 35 kg/cm$^2$G, and the solvent was a butane mixture. In addition, the extraction temperature was 100° C.

From these results, it is understood that in order to change the extraction rate, the type of solvent, the extraction temperature, and the rate of flow of the solvent (solvent ratio) should be changed.

The reaction conditions (process conditions) of hydrogenation processes such as desulfurizing, demetalizing, denitrifying, and hydrocracking are strongly related to the extraction rate, and as shown in FIG. 7, where the extraction rate is high, the reaction conditions become severe. Here, FIG. 7 shows the relationship between the yield (extraction rate) of the deasphalted oil (extracted oil) and the conversion rate due to hydrocracking. As shown in FIG. 7, based on the constant reaction conditions, when the extraction rate of the extracted oil exceeds 85%, the hydrocracking activity rapidly decreases. The relationship between this extraction rate and the conversion rate is the result of combining carrying out the solvent extraction process by using the vacuum residue of Arabian light as a feed oil and carrying out hydrogenation process on the obtained deasphalted oil (extracted oil).

We note that the extraction rate differs depending on the type of the feed oil, and that the residue rate for impurities thereof is also different. Therefore, simply controlling only the extraction rate of the extracted oil that becomes the processed oil, that is, the extraction rate in the solvent extraction process, is not sufficient for carrying out hydrogenation process under appropriate operating conditions, particularly in the case that the type of the feed oil differs.

Thus, the factors that influence the reaction conditions (process conditions) of the hydrogenation process were found, and then the factors that can appropriately control the operating conditions of the solvent extraction were found as follows.

First, in order to ascertain the characteristics of the heavy oil that will serve as the feed oil, the fraction that cannot be fractionally distilled is separated into the following fractions by column chromatographic analysis using a solvent and an absorbent.

saturate (saturated composition; abbreviated SA)
mono-aromatics (abbreviated MA)
di-aromatics (abbreviated DA)
tri-aromatics (abbreviated TA)
poly-aromatics and polar compounds (abbreviated PP)
residue (the heptane insoluble component; abbreviated C7Insol)

Moreover, the following column chromatographic analysis was carried out based on the methods of D. E. Hirsh et al [Anal. Chem. 44, No. 6, 915 (1972)].

In a column prepared to provide a silica gel layer on top of an alumina gel layer, and a measured test sample is dissolved in a small amount of heptane and soaked into the top of the silica gel layer.

Next, prescribed solvents (five types of solvent: n-pentane, 5 vol % benzene/n-pentane, 20 vol % benzene/n-pentane, benzene, and 50 vol % benzene/methyl alcohol) are added in sequence, the test sample that is absorbed by the absorbent is eluted, and each fraction is recovered.

The solvent is eliminated from the recovered fractions, the weight of each of the fi-actions is measured, and the content is calculated.

For reference, the fractional properties of the respective fractions are shown in FIG. 8. Each has an extremely high boiling point, and in particular, the PP (poly-aromatics component) includes components that do not distill out even at 1100° C. In addition, the residue has a boiling point that is too high to measure.

Thus, the relationship to the reaction was studied focusing in particular on the PP and the C7Insol.

FIG. 9 shows the result of studying how the amount of each component included in the feed oil that migrates to the extracted oil changes depending on the extraction rate. According to FIG. 9, it can be understood that the SA, MA, DA, TA and the like that are above the diagonal line (not illustrated) are extracted excessively as this extraction rate, while in contrast, almost no PP and Residue (C7Insol), which are below the diagonal line (not illustrated), are extracted at a very low extraction rate.

FIG. 7 shows that the reaction in the hydrogenation process (hydrocracking) becomes rapidly lower when the extraction rate of the deasphalted oil (extracted oil) exceeds 60 to 85%. From the results shown in FIG. 9, we consider this to be due to the concentration of the residue (C7Insol) in the extracted oil (deasphalted oil) that will serve as the processed oil heavily influencing the reactive operation of the hydrogenation process.

The results shown in FIG. 9 are shown in FIG. 10 as the relationship between the extraction rate and the action of each component shown using the feed oil as the reference. Moreover, in FIG. 10, the yield of each of the components for each of the extraction rates is the value shown by the interval between each of the curves (where SA is the value shown by the interval between the curve and the X-axis, and C7Insol is the value shown by the interval between the diagonal line and the curve).

From these results, in particular when examining of the C7Insol in the extracted oil obtained by the solvent extraction process, carrying out this hydrogenation process under conditions that are more severe than necessary can be prevented by establishing the conditions for the last stages of the hydrogenation process according to this C7Insol. In addition, if the solvent extraction process is carried out such that the value of the C7Insol of the extracted oil is set to a value that is lower than a certain reference value, the hydrogenation process during the later stages can be carried out under sufficiently mild conditions.

Thus, the following experiments were conducted in order to establish the reference value of the C7Insol for this type of extracted oil.

Feed oils were prepared having amounts (wt %) of each impurity shown below:

| | |
|---|---|
| SA | 4.38 wt % |
| MA | 9.86 wt % |
| DA | 11.34 wt % |
| TA | 21.25 wt % |
| PP | 40.57 wt % |
| C7Insol | 12.63 wt % |

Next, these feed oils were respectively subject to the solvent extraction process in a range of 30 wt % to 90 wt % at 5 wt % intervals. The extraction rate of the DAO (deasphalted oil), which is the obtained extracted oil, and the amount of each impurity in the DAO obtained at each of the extraction rates, that is, the weight % of the entire fraction that could not be fractionally distilled, were found, and these are shown in Table. 1. Moreover, the amount of each of the impurities was measured by the column chromatographic analysis method described above.

TABLE 1

| DOA (wt %) | SA | MA | DA | TA | PP | C7Insol | Total | [C7/PP] |
|---|---|---|---|---|---|---|---|---|
| 30 | 13.0 | 19.4 | 18.7 | 19.7 | 25.8 | 3.3 | 99.9 | 0.128 |
| 35 | 11.7 | 20.3 | 20.3 | 20.3 | 23.9 | 3.4 | 99.9 | 0.143 |
| 40 | 10.5 | 20.1 | 20.5 | 21.3 | 24.1 | 3.5 | 100.0 | 0.144 |
| 45 | 9.6 | 19.1 | 20.2 | 22.6 | 24.7 | 3.8 | 100.1 | 0.155 |
| 50 | 8.7 | 18.0 | 19.4 | 24.1 | 26.1 | 3.8 | 100.1 | 0.147 |
| 55 | 8.1 | 17.0 | 18.5 | 25.5 | 26.8 | 4.1 | 100.1 | 0.152 |
| 60 | 7.4 | 16.2 | 17.8 | 25.5 | 28.7 | 4.3 | 100.0 | 0.149 |
| 65 | 6.9 | 15.3 | 17.0 | 25.4 | 30.9 | 4.6 | 100.1 | 0.148 |
| 70 | 6.4 | 14.2 | 15.9 | 24.9 | 33.9 | 4.7 | 100.0 | 0.140 |
| 75 | 5.9 | 13.4 | 15.1 | 24.2 | 36.2 | 5.1 | 100.0 | 0.142 |
| 80 | 5.5 | 12.5 | 14.2 | 23.8 | 38.5 | 5.5 | 100.0 | 0.142 |
| 85 | 5.2 | 11.7 | 13.5 | 23.2 | 40.2 | 6.1 | 100.0 | 0.152 |
| 90 | 4.9 | 11.1 | 12.8 | 22.8 | 41.2 | 7.1 | 100.0 | 0.173 |

Considering the results of Table 1 together with the results shown in FIG. 7, that is, results showing that when the extraction rate of the deasphalted oil (extracted oil, DAO) exceeds 60 to 85%, the reaction of the hydrogenation process in the later stage decreases rapidly, the refining method for heavy oil of the present invention is characterized in that the predetermined component concentration in the extracted oil obtained by the solvent extraction process is detected, and at the same time the extraction conditions are controlled according to these detected values.

When the predetermined component described above is, for example, C7Insol, and this is set equal to or less than a particular concentration, that is, the amount of C7Insol is set to an amount just before the point that the reaction of the hydrogenation process decreases rapidly, by subjecting the extracted oil obtained in this manner to a hydrogenation process, the reaction can be manipulated under comparatively mild conditions. Therefore, the drawbacks that the maintenance of the hydrogenation process apparatus consumes much time, that the cost is high, and that the service life of the apparatus itself is short, can be improved.

We note that the components of the C7Insol are unclear, and that therefore to determine their amounts, a method such as the column chromatographic analysis described above must be used, and thus a continuous analysis cannot be carried. Therefore, we focused on poly-aromatics (PP), on which continuous analysis can be carried out.

As shown in Table 1, in a range 55 to 85%, in which the normal extraction operation is carried out, the value of the C7Insol to PP is substantially constant (in the example of Table 1, 0.140 to 0.152, where these values change depending on the type of feed oil). Therefore, within this range, it is understood that the value of the PP can be used as the index instead of the value of C7Insol.

Thus, one of the characteristics of the refining method of heavy oil according to the present invention is setting predetermined values for the concentration of the heptane insoluble components in the fraction of the extracted oil obtained by the solvent extraction process that cannot be fractionally distilled, that is, the concentration of the poly-aromatic component in the fraction that cannot be fractionally distilled, or in other words, the concentration of the heptane insoluble components assigned based on the PP.

Poly-aromatic components comprise the poly-aromatics and polar compounds described above, and the concentration thereof can be measured continuously by analyzer such as a Near Infrared Spectroscopic Analyzer or a Nuclear Magnetic Resonance Analyzer.

Therefore, the correlation between the detection signal obtained by these analyzer and the concentration of the PP can be clarified in advance experimentally, and furthermore, as shown in Table 1, the correlation between the concentration of the PP and the concentration of the C7Insol can be clarified in advance. Thereby, the concentration of the C7Insol can be known from the concentration of the PP obtained by the analyzers.

The relationship between the detection signal and the PP concentration described above will be explained in greater detail.

To carry out the refining method of the present invention, a calibration curve can be established by finding the correlation between the concentration of the C7Insol and the concentration of the poly-aromatics during the extraction and refining by using extraction conditions for the feed oil that is the object of refining and the extraction solvents. In addition, based on a normal value corresponding to the C7Insol concentration in the refined oil that depends on the targeted degree of refining, the poly-aromatic concentration information corresponding to this normal value is input into the control device of the refining facility, and thereby the concentration of this C7Insol can be indirectly controlled.

The poly-aromatic concentration corresponding to the C7Insol determined according to the specifications of the target refined oil serve as the normal value, and in the case that the detected value in the extracted oil is large with respect to this normal value, the extraction conditions are controlled so that the extraction rate is lowered, and in the case that the detected value in the extracted oil is small with respect to the normal value, the extraction rate in the extraction process step is controlled so as to increase. This normal value can have a predetermined range, and in this case, the conditions can be controlled with respect to a maximum or minimum value thereof.

In this manner, by keeping the concentration of the C7Insol within an appropriate range, the operating conditions (process conditions) in the hydrogenation process, which is one of the later stages in this solvent extraction process, do not become severe, and can be made comparatively mild conditions.

As described above, the refining method for heavy oil according to the present invention is characterized in that, because it was discovered that the C7Insol in the extracted oil is correlated with the poly-aromatic concentration, the extraction process can be indirectly controlled so that the C7Insol in the refined oil remains equal to or less than a predetermined concentration by using the poly-aromatic concentration in the extracted oil as an index. Furthermore, the hydrorefining process can be controlled so that the C7Insol in the hydrorefined oil obtained in the hydrorefining process subsequent to the extraction process finally becomes equal to or less than a predetermined concentration.

Furthermore, the refining facility for heavy oil according to the present invention is characterized in providing a detecting device that detects the concentration of the poly-aromatic component in the extracted oil obtained by the solvent extraction process and a control device that controls the process conditions of the solvent extraction process apparatus depending on the values provided by the detecting device, and furthermore, a device that controls the refining conditions of the hydrorefining unit provided in the later stage of the solvent extraction unit is provided.

In addition, due to being structured as described above, the desired degree of refining, in other words, the amount of C7Insol included, can be reliably and simply refined by using the concentration of poly-aromatics as an index, and the operating conditions of the hydrorefining provided in the later stages of the solvent extraction can be operated under relatively mild conditions. Thereby, facility expenses such as the operating cost, the maintenance cost, and the like can be decreased. Therefore, grades of oil products can be and economically easily manufactured according to their economic object.

BEST MODE FOR CARRYING OUT THE INVENTION

Below, the present invention will be explained in detail.

Figure 1:
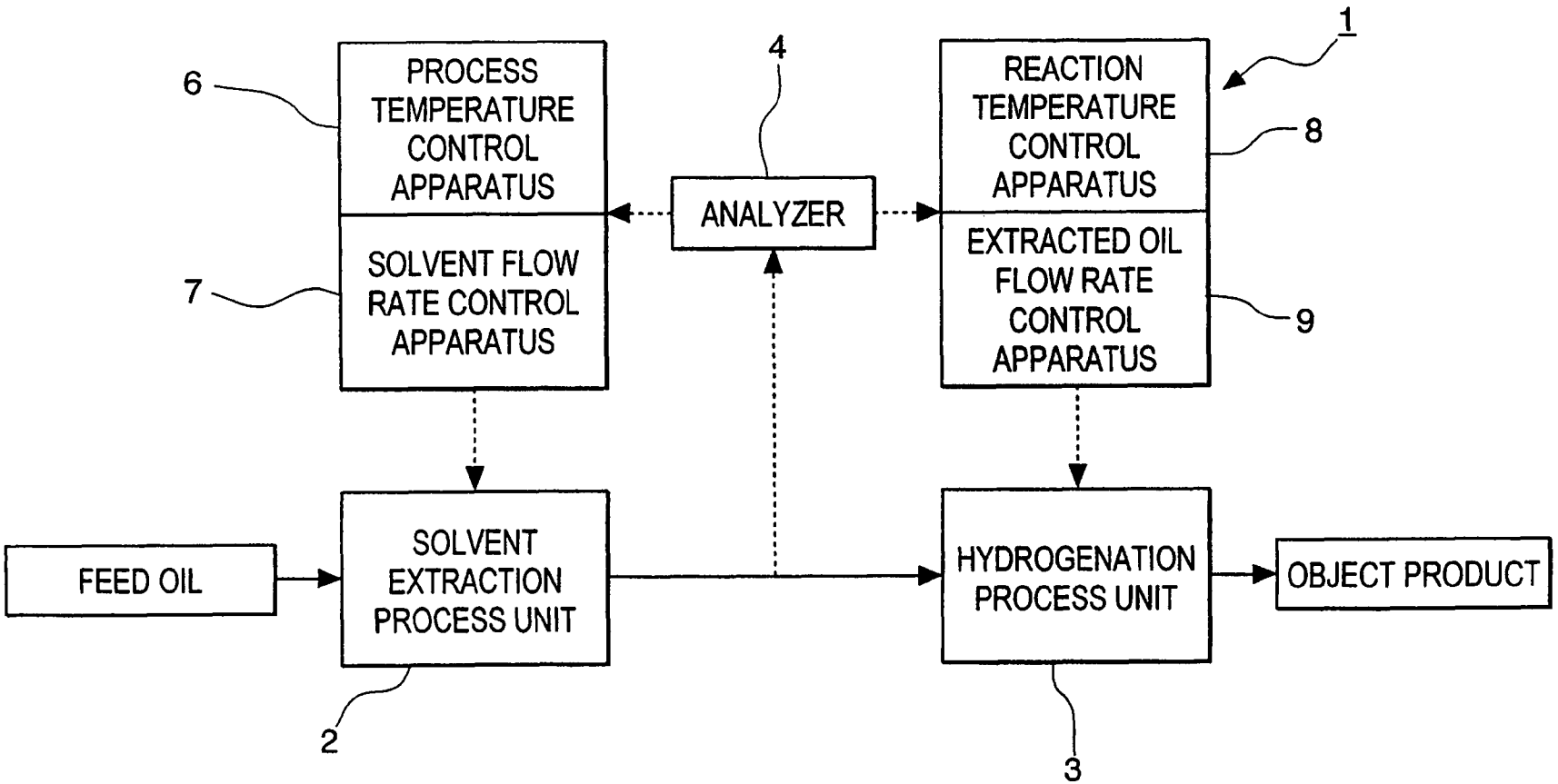
FIG. 1 is a drawing showing the schematic structure of the embodiment of the refining facility for heavy oil according to the present invention.

FIG. 1 is a drawing showing an embodiment of the refining facility for heavy oil according to the present invention, where reference numeral 1 in the drawing denotes the refining facility for heavy oil. This refining facility 1 is a facility that refines grades of oil from a feed oil according to their object, and provides a solvent extraction process unit 2 and a hydrogenation process unit 3. An analyzer 4 that detects the concentration of the poly-aromatics in the obtained extracted oil is provided at the later stage of the solvent extraction process unit 2.

Figure 2:
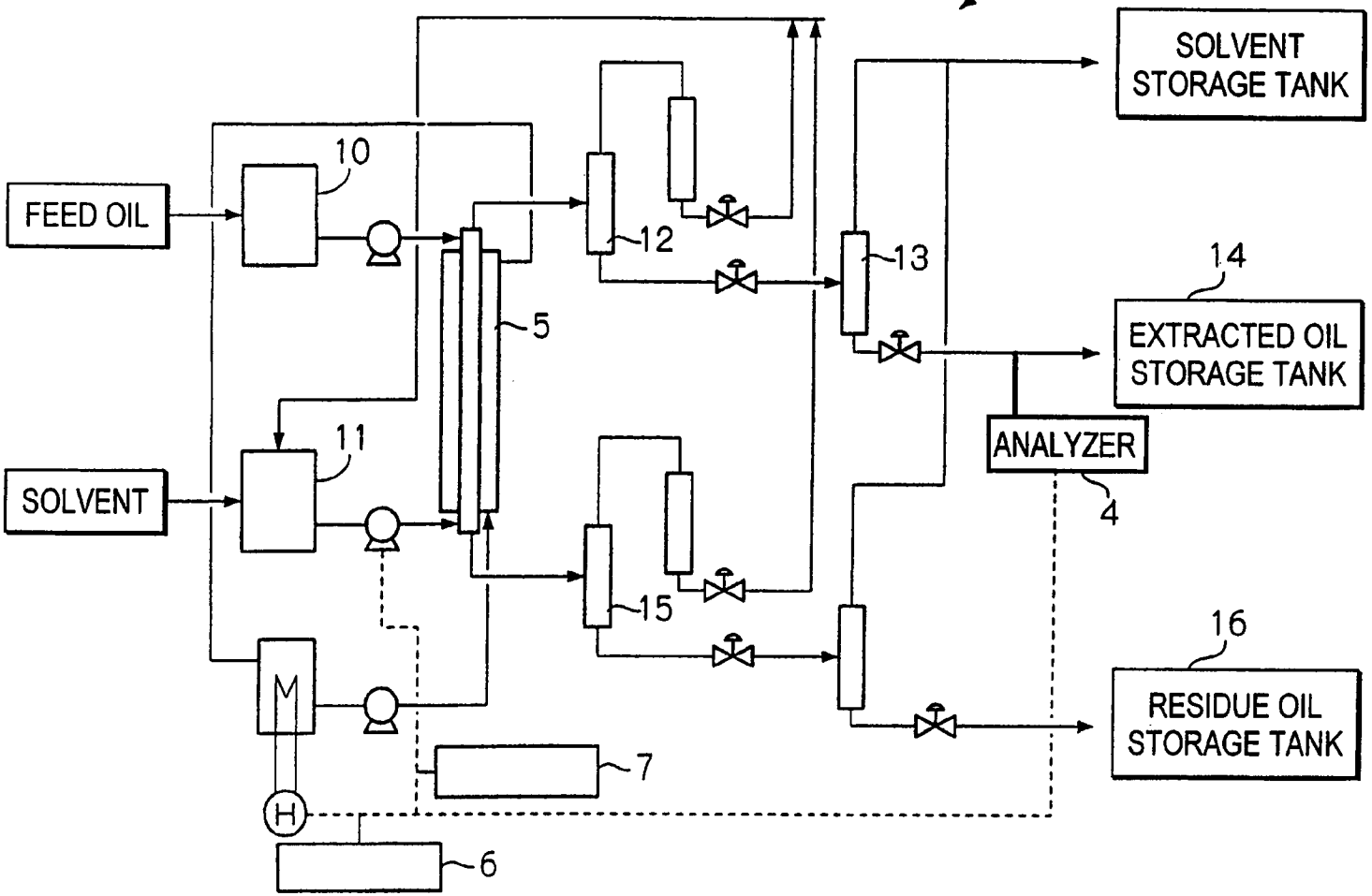
FIG. 2 is a drawing showing a schematic structure of the solvent extraction process apparatus in the refining facility for heavy oil shown in FIG. 1.
Figure 3:
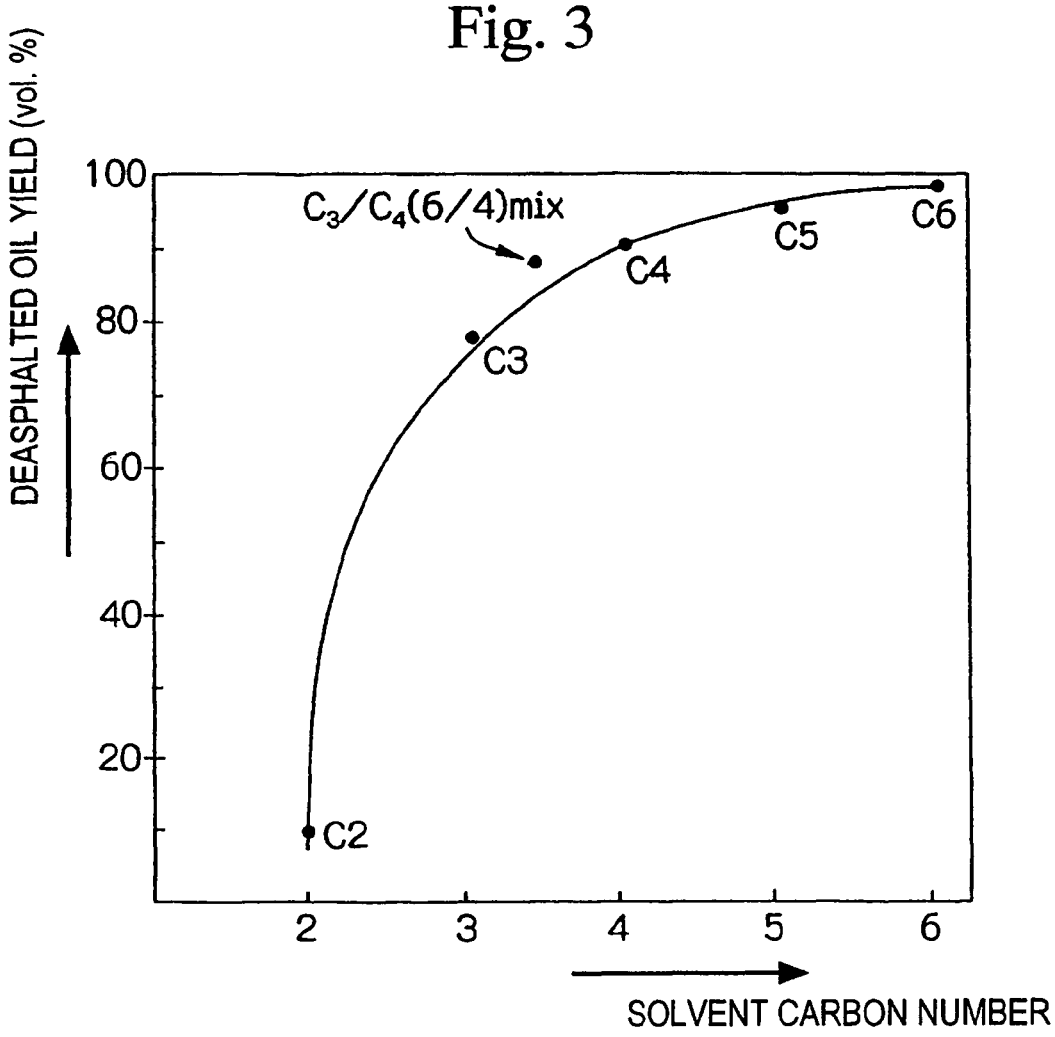
FIG. 3 is a graph showing the relationship between the type of extraction solvent (the carbon number of the solvent) and the deasphalted oil extraction rate.
Figure 4:
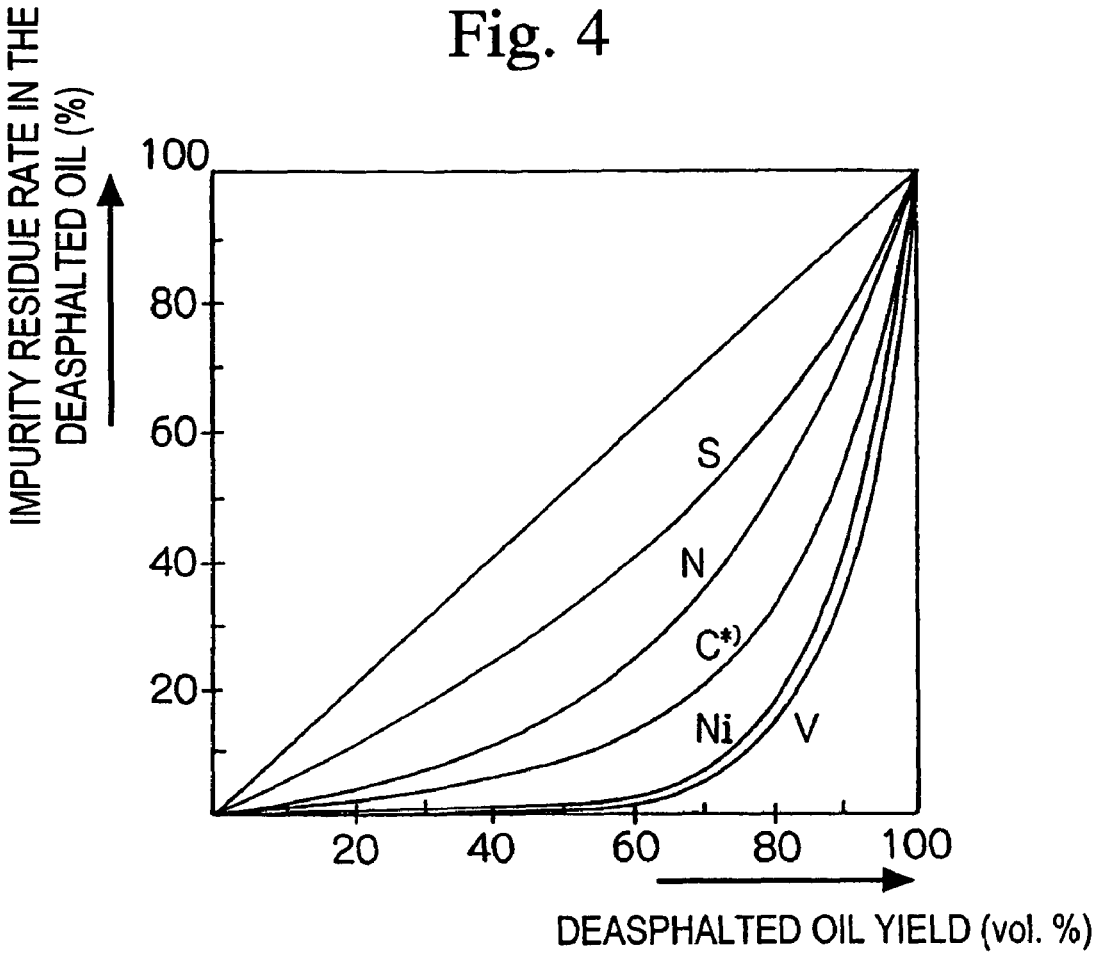
FIG. 4 is a graph showing the residual rate of each of the impurities in the deasphalted oil with respect to the extraction rate of the deasphalted oil.
Figure 5:
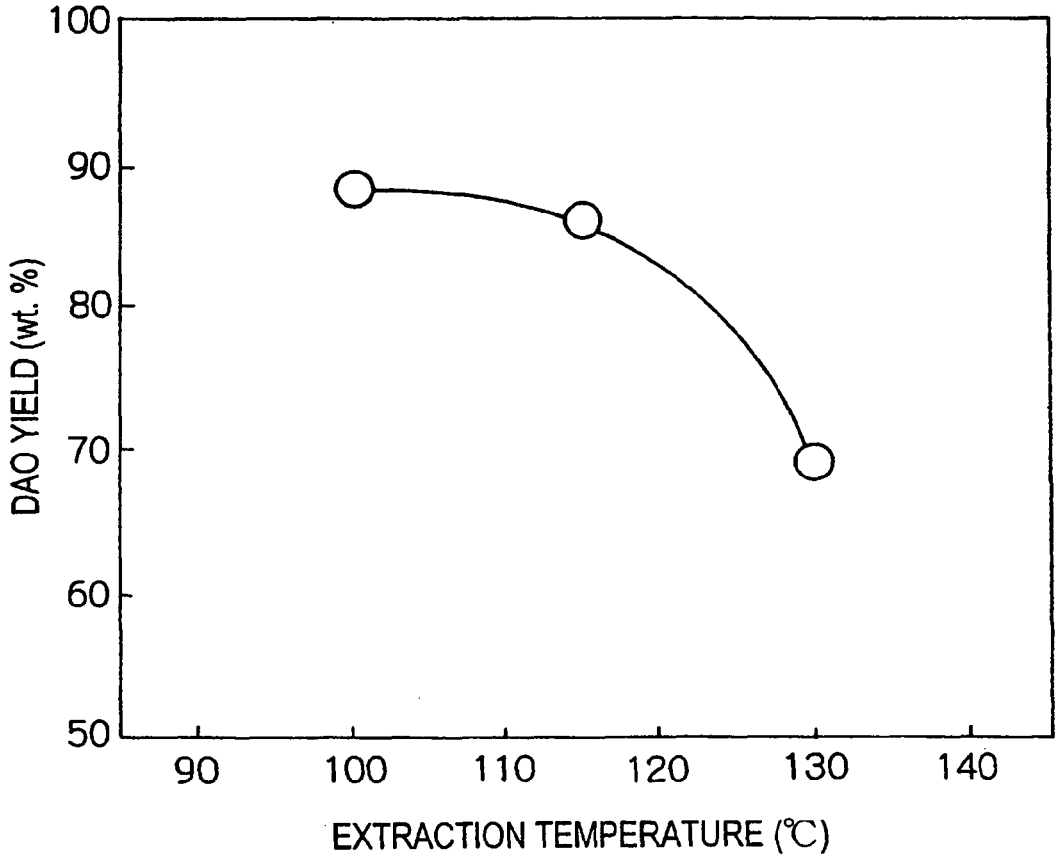
FIG. 5 is a graph showing the relationship between extraction temperature and the extraction rate of the deasphalted oil.
Figure 6:
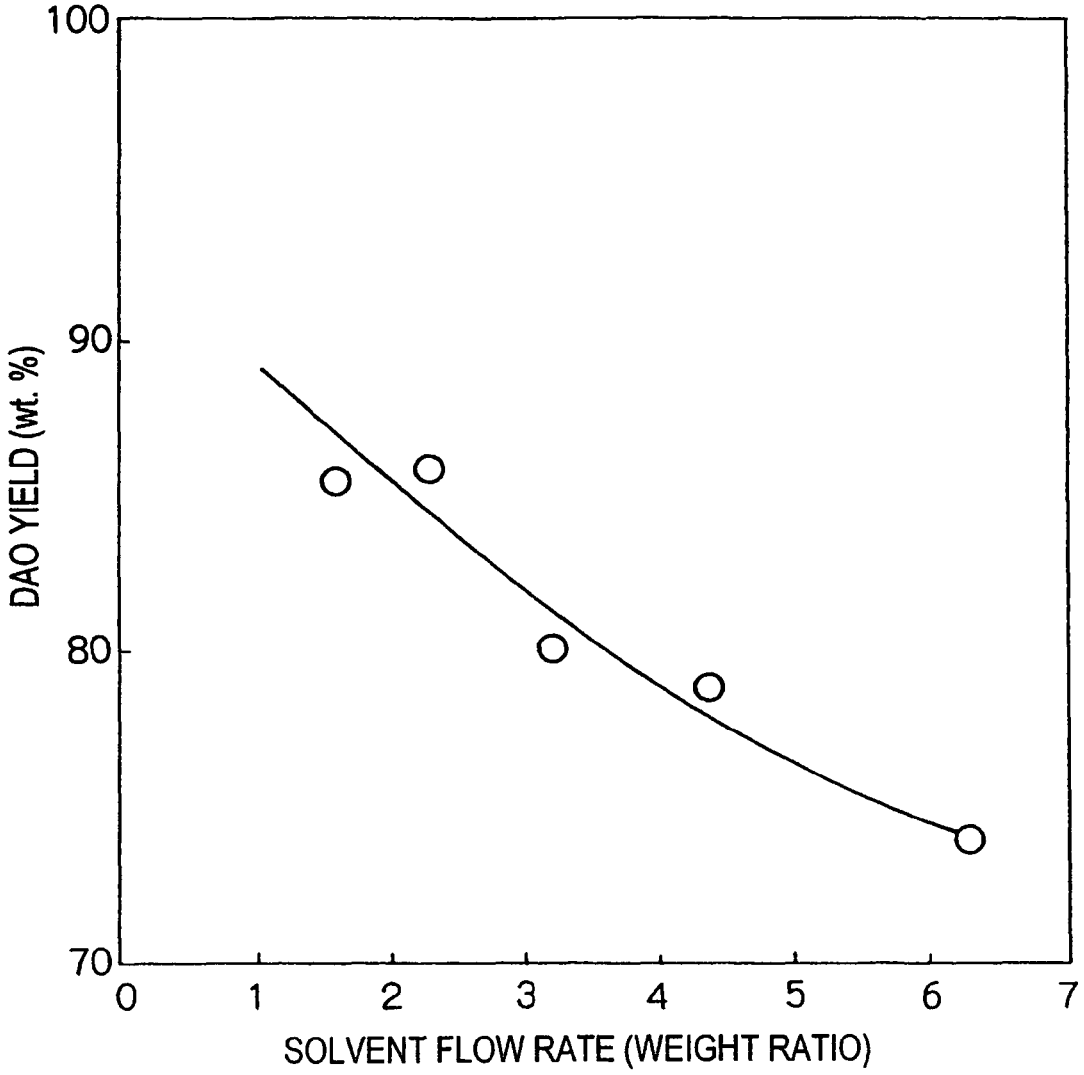
FIG. 6 is a graph showing the relationship between the flow rate of the solvent and the extraction rate of the deasphalted oil.
Figure 7:
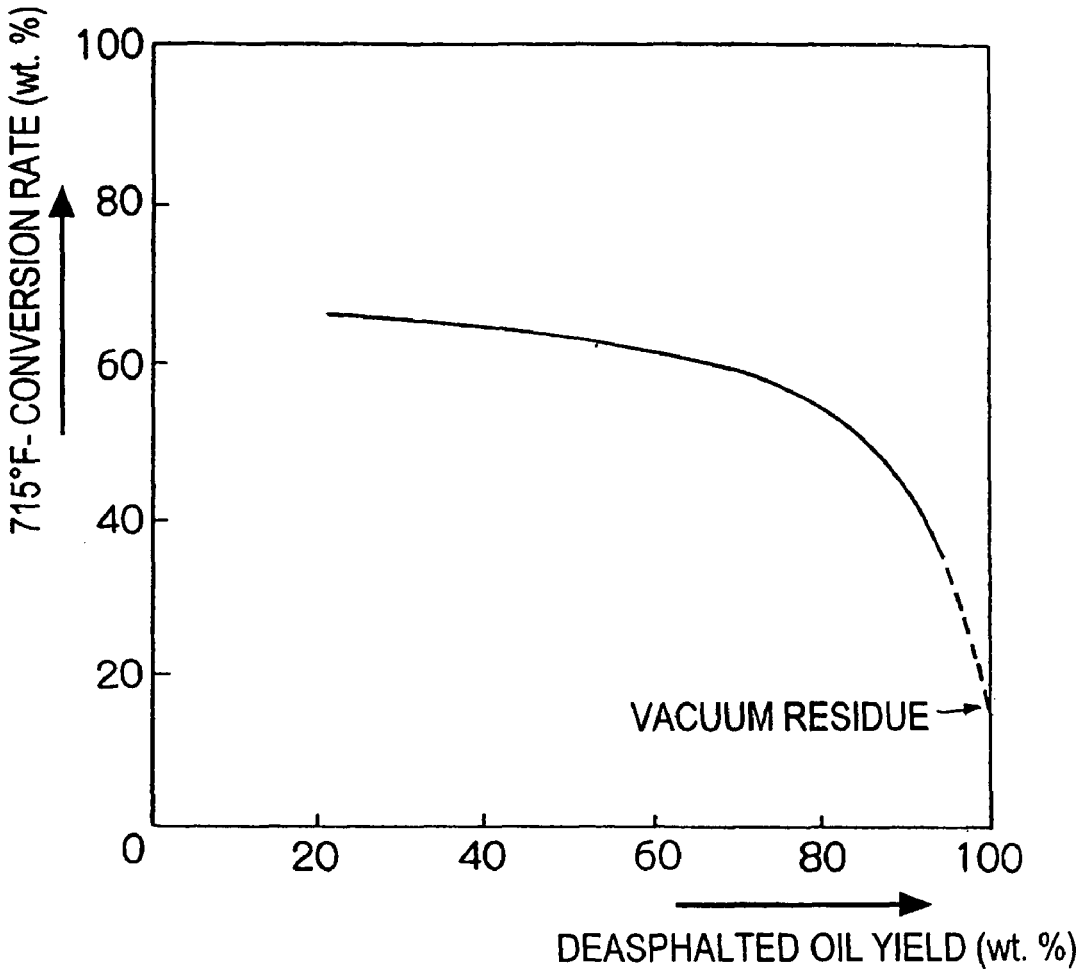
FIG. 7 is a graph showing the relationship between the extraction rate of the deasphalted oil and the transfer rate due to hydrocracking.
Figure 8:
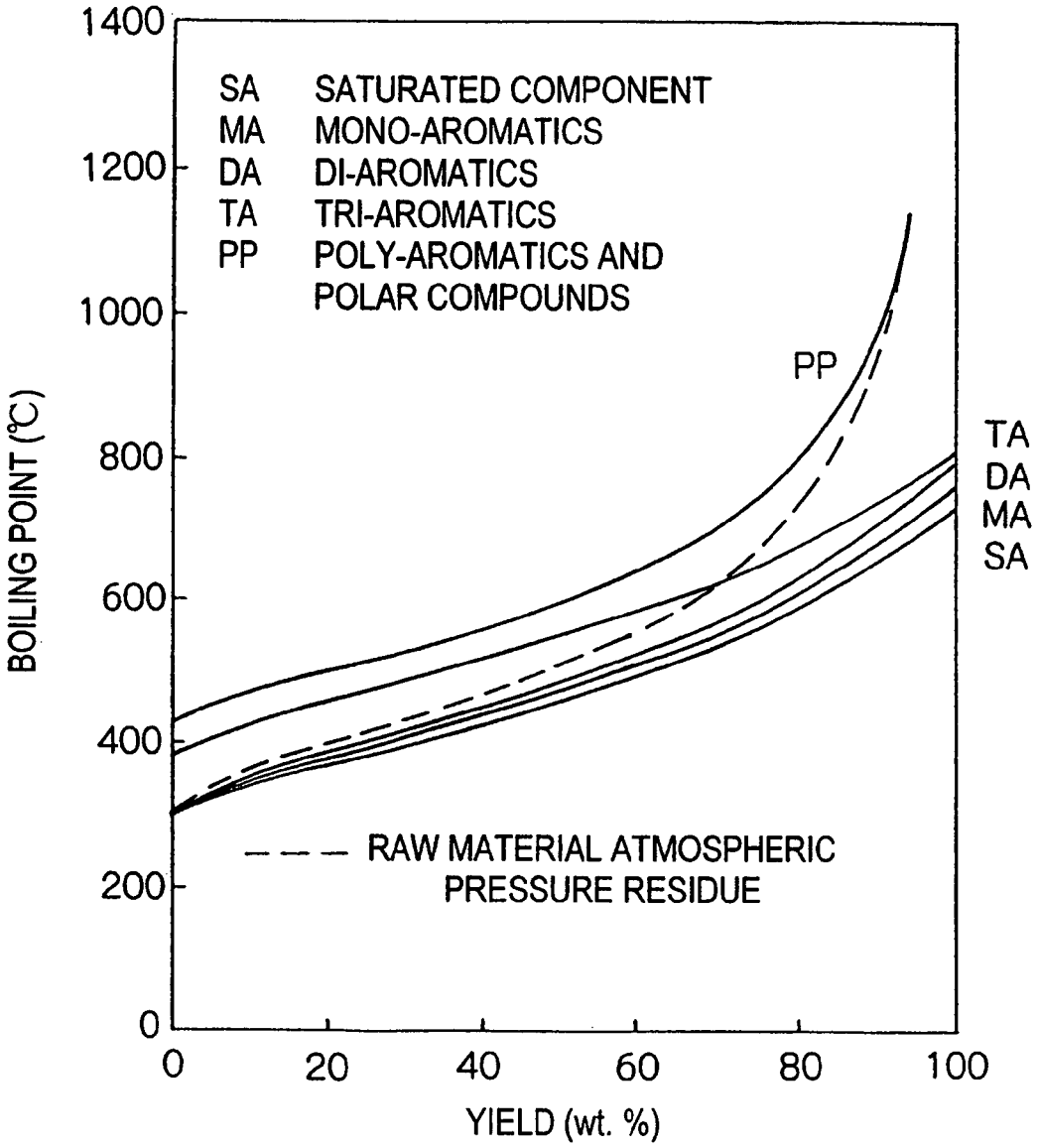
FIG. 8 is a graph showing the distillation properties of the residue.
Figure 9:
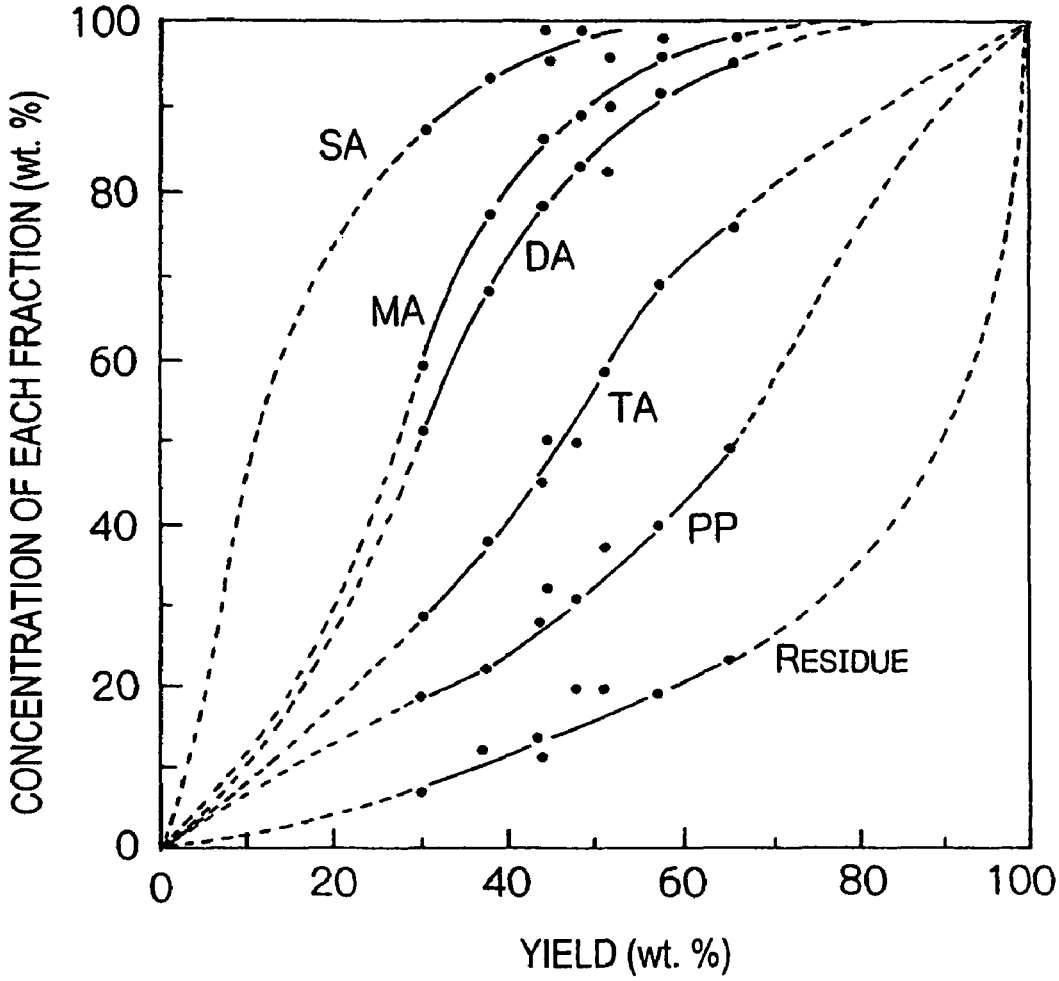
FIG. 9 is a graph showing the relationship between the extraction rate of the deasphalted oil.
Figure 10:
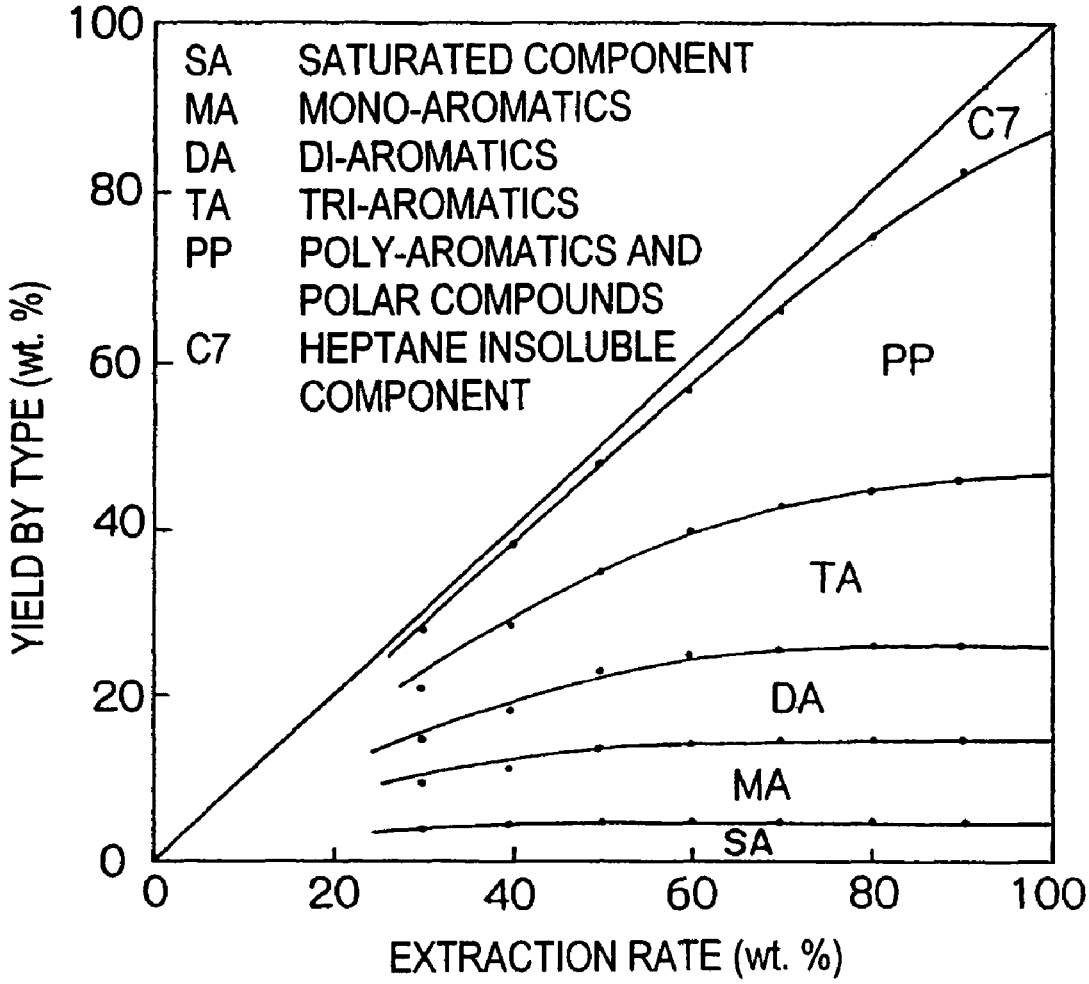
FIG. 10 is a graph showing the relationship between the extraction rate of the deasphalted oil and the concentration of each of the residues in the deasphalted oil.

The solvent extraction process unit 2 is a unit that obtains an extracted oil by carrying out the solvent extraction process on the feed oil, and as shown in FIG. 2, provides an extraction column 5. In this extraction column 5, the solvent extraction process is carried out. In addition, the solvent extraction process unit 2 provides a process temperature control apparatus 6 that controls the temperature of the extraction process that is carried out in the extraction column 5 and a solvent flow rate control apparatus 7 that controls the flow rate of the solvent that flows into the extraction column 5. These are structured such that the process temperature or solvent flow rate are controlled so as to form optimal extraction conditions by a control program set in advance based on the concentration of the poly-aromatics (PP) in the extracted oil obtained by the analyzer 4, which will be explained below.

The hydrogenation process unit 3 is a unit that carries out hydrogenation process on the extracted oil obtained by the solvent extraction process unit 2 in the presence of hydrogen and a catalyst to obtain a hydrorefined oil, and generates various types of oil products or intermediary oil products such as the raw material for fluid catalytic cracking (FCC), which is the refined oil according to their object.

The concrete processing by the hydrogenation process unit 3 includes all reactions that occur in the presence of hydrogen and a catalyst, and generally comprise a hydrocracking reaction, a hydrodesulfurizing reaction, a hydrodemetalizing reaction, and a hydrodenitrifying reaction. Generally, in the hydrocracking reaction, hydrocarbons are cracked under high temperature and high pressure in a hydrogen atmosphere, and a low atomic weight refined oil is obtained from the processed oil (extracted oil). In the hydrodesulfurizing reaction, sulfur compounds in the hydrocarbons are reacted with hydrogen under high temperature and high pressure in a hydrogen atmosphere to form hydrogen sulfide. In addition, after being introduced into the separator vessel, the hydrogen sulfide is separated, and a refined oil having a lower sulfur concentration than the processed oil (extracted oil) is obtained.

In the hydrodemetalizing reaction, the metal compounds in the carbohydrates are hydrogenated under high temperature and high pressure in a hydrogen atmosphere to form elemental metals which are then deposited on the catalyst. Thereby, a refined oil having a metal concentration that is lower than the processed oil (extracted oil) is obtained. In the hydrodenitrifying reaction, the nitrogen compounds in the hydrocarbons are reacted with hydrogen under a high temperature and high pressure in a hydrogen atmosphere to obtain ammonia. In addition, after being introduced into the separator vessel, the ammonia is separated to obtain a refined oil having a nitrogen concentration that is lower than the processed oil (extracted oil).

In this type of hydrogenation process, in any case, a factors that control the reaction rate comprise the ratio of supplied hydrogen to feed oil, the ratio of the volumetric flow rate (LHSV: liquid hourly space velocity) to the catalyst, the reaction temperature, the catalyst type, and the like, and these respectively differ depending on the type of hydrogenation process that is the general object.

We note that generally in a hydrogenation process unit the reaction pressure, size of the reaction vessel, and the like are fixed based on the apparatus design, and therefore among the control factors described above, the preferable objects of control are the hydrogen to oil ratio, the reaction temperature, and the flow rate of the extracted oil.

As shown in FIG. 1 the hydrogenation process unit 3 described above provides a reaction temperature control apparatus 8 that controls the reaction temperature in this hydrogenation process unit 3 and a extracted oil flow rate control apparatus that controls the flow rate of the extracted oil that flows into this hydrogenation process unit 3. These are structured so as to control the reaction temperature or extracted oil flow rate so as to form optimal hydrogenation conditions by a control program that is set in advance based on the concentration of the poly-aromatics (PP) in the extracted oil obtained on the analyzer 4 explained next.

The NIR analyzer or the NMR analyzer described above is preferably used as an analyzer 4. Each of the control apparatuses described above, specifically, the process temperature control apparatus 6 and the solvent flow rate control apparatus 7 in the solvent extraction process unit 2 and the reaction temperature control apparatus 8 and the extraction oil flow rate control apparatus 9 in the hydrogenation process unit 3 are connected to this analyzer 4. Here, this analyzer 4 measures the total amount of fraction that cannot be fractionally distilled from a given amount of extracted oil and the amount of PP (poly-aromatics) therein are measured, and by mathematical processing of this result, the concentration of the poly-aromatics (PP) in the extracted oil, that is, the concentration of poly-aromatics (PP) in the fraction of the extracted oil that cannot be fractionally distilled, is detected.

To carry out the refining of heavy oil by the refining facility 1 having this type of structure, first the solvent extraction process of the feed oil is carried out in the solvent extraction process unit 2. In this solvent extraction process unit 2, first, as shown in FIG. 2, the feed oil is sent to the feed oil storage tank 10 and stored there, while the solvent is sent to the solvent storage tank 11 and stored there. In addition, based on predetermined operating conditions (process conditions), the feed oil and the solvent are supplied to the extraction column 5, which is controlled so as to maintain a predetermined pressure and temperature. Here they are mixed and the extraction process is carried out.

In this manner, when the extraction process is carried out in the extraction column 5, the obtained extracted oil is separated from the solvent by the extraction oil/solvent separating device 12. In addition, the solvent remaining in the extracted oil is removed by the extracted oil separating column 13, and subsequently sent to the extracted oil storage tank 14 to be stored therein. In contrast, the solvent is separated from the residue obtained from the extraction column 5 by the residue/solvent separating device 15 to be finally stored in the residue storage tank 16.

In this type of continuous the extraction process, before the extracted oil guided from the extracted oil separating column 13 flows into the extracted oil storage tank 14, the concentration of the poly-aromatics (PP) is continuously detected by the analyzer 4. In addition, the obtained results are converted to a detection signal and respectively sent (as feedback) to the process temperature control apparatus 6 and the solvent flow rate control apparatus 7 of the solvent extraction process unit 2 as well as the reaction temperature control apparatus 8 and the extraction oil flow rate control apparatus 9 in the hydrogenation process unit 3. The analyzer 4 continuously carried out detection to the extent that this does not hinder the operation of the extraction unit, for example, at 5 minute intervals.

Based on a pre-set control program, in the process temperature control apparatus 6 and the solvent flow rate control apparatus 7 that receive the detection signal from the analyzer 4, the extraction temperature is raised and the extraction rate is lowered by the process temperature control apparatus 6 when, for example, the value of the PP is higher than the 40.2 wt % (refer to Table 1) that corresponds to the 6.1 wt %, which is the reference concentration of the C7Insol, and thereby the value of the PP (that is, the concentration of the C7Insol) is lowered. In contrast, the flow rate of the solvent can be raised and the extraction rate lowered by the solvent flow rate control apparatus 7, and thereby the value of the PP (that is, the concentration of the C7Insol) lowered. For these operations, both controls can be carried out simultaneously, or only one of them can be carried out. The efficiency is investigated experimentally in advance from the point of view of cost and production efficiency, and these controls are programmed in advance so as to establish optimal conditions.

In addition, by detecting the value of the PP with this type of analyzer 4 and storing the detected data, the amount (concentration) of the PP in the extracted oil stored in the extracted oil storage tank 14 can be known, and thus the concentration of the C7Insol can be known. Therefore, when the extracted oil stored in this extracted oil storage tank 14 undergoes hydrogenation process in the hydrogenation process unit 3, the hydrogenation process can be carried out under operating conditions that are optimal for the properties of this extracted oil.

Specifically, with regard to the extracted oil obtained by the solvent extraction process unit 2, although the value of the PP is maintained equal to or less than a reference value by feedback control by the analyzer 4, naturally fluctuation of this value will occur within a range equal to or less than this reference value. Therefore, since they are equal to or less than the reference value, the reaction conditions in the hydrogenation process unit 3 are not severe, and the process can be carried out under mild conditions. In contrast, these conditions are not necessarily the best reaction conditions corresponding to the concentration of the PP (that is, the concentration of the C7Insol that characterizes it) if the process is simply carried out under constant conditions.

Thus, in the hydrogenation process unit 3, based on the data detected and sent by the analyzer 4, that is the amount (concentration) of the PP for the extracted oil that becomes the processed oil stored in the extracted oil storage tank 14, either one or both of the reaction temperature control apparatus 8 and the extracted oil flow rate control apparatus 9 are controlled, and thereby the process can be carried out under mild conditions that are mild and that sufficiently satisfy the properties of the object oil product (or intermediate oil product). In addition, with regard to these controls, like the case of the solvent extraction process unit 2 described above, the efficiency is investigated in advance experimentally from the point of view of cost and production efficiency, and these controls are programmed in advance so as to establish optimal conditions.

Moreover, when carrying out the process using this hydrogenation process unit 3, the amount (concentration) of the PP of the extracted oil (processed oil) stored in the extracted oil storage tank 14 can be known from the data accumulated by the analyzer 4 described above, and thereby because the concentration of the C7Insol can also be known, for example, by appropriately selecting hydrogenation process unit 3 that differ in type or size, not only the reaction temperature and the extracted oil flow rate described above, but also the reaction pressure and the catalyst type can be suitably selected, and thereby further optimization of the hydrogenation process can be implemented.

Therefore, in this type of refining facility 1 for heavy oil, of course the hydrogenation process can be carried out under comparatively mild conditions, but in addition refined oil products according to their object or intermediate oil products of various types can be flexibly produced.

EXAMPLES

Below, the present invention will be concretely explained using examples.

Example 1

In order to manufacture the feedstock for fluidized catalytic cracking, the feed oil 1 below undergoes the solvent extraction process, and the extracted oil is manufactured. Moreover, as a feedstock for the fluidized catalytic cracking, because metal concentrations, residue carbon, and sulfur concentrations are limited, the reaction conditions and reaction rates of the later stages of the hydrogenation process must be taken into account, and the extraction process is controlled such that the concentration of the heptane insoluble (C7Insol) in the fraction of the obtained extracted oil that cannot be fractionally distilled is equal to or less than 5.5 wt %, and the concentration of the poly-aromatic (PP) in the fraction of the extracted oil that cannot be fractionally distilled is equal to or less than 38.5 wt %.

| | Feed oil 1 | Feed oil 2 |
|---|---|---|
| Specific gravity (15/4° C.) | 1.032 | 0.952 |
| Viscosity at 210 F. (cSt) | 4327 | 80 |
| Sulfur concentration (wt %) | 4.91 | 0.19 |
| Ni (ppm) | 35 | 29 |
| V (ppm) | 143 | 0 |
| Asphaltene (wt %) | 11.7 | 0.5 |
| Saturated component (wt %) | 4.4 | 38.5 |
| Mono-aromatics (wt %) | 9.9 | 29.7 |
| Di-aromatics (wt %) | 11.3 | 17.3 |
| Tri-aromatics (wt %) | 21.3 | 8.5 |
| Poly-aromatics (wt %) | 40.6 | 5.3 |
| Solvent insoluble component (wt %) | 12.6 | 0.7 |

The process conditions (operating conditions) of the extraction process apparatus and the properties of the obtained extracted oil are as follows:

| | | Extraction results |
|---|---|---|
| Process conditions | Feed oil | Feed oil 1 |
| | Solvent type | pentane |
| | Solvent/feed oil mass ratio | 2.0 |
| | Extraction temperature (° C.) | 150 |
| | Extraction pressure (kg/cm$^2$G) | 20 |
| | Insoluble component concentration set value (wt %) | 5.5 |
| | PP value corresponding to insoluble component control (wt %) | 38.5 |
| Properties | Extracted oil yield (wt %) | 79.9 |
| | Specific gravity (15/4° C.) | 1.002 |
| | Viscosity at 210 F. (cSt) | 557 |
| | Sulfur concentration (wt %) | 4.06 |
| | Ni (ppm) | 8.3 |
| | V (ppm) | 48.1 |
| | Measured insolvent component concentration (wt %) | 5.2 |

From the above results, by controlling the extraction process such that the concentration of PP is equal to or less than 38.5 wt %, the measured insoluble component concentration (heptane insoluble component concentration) becomes 5.2 wt %, and can be produced at the target concentration (equal to or less than 5.5 wt %) of the heptane insoluble component (C7Insol).

In addition, in carrying out the hydrogenation process on the extracted oil obtained in this manner, the object feedstock for the fluidized catalytic cracking can be manufactured by processes at mild reaction conditions that do not place a great load on the hydrogenation process unit.

INDUSTRIAL APPLICABILITY

The refining method for heavy oil of the present invention as explained above is a method that provides a solvent extraction process that obtains an extracted oil by the solvent extraction process and a hydrorefining process that obtains a hydrorefined oil by subjecting the obtained extracted oil to hydrogenation process in the presence of hydrogen and a catalyst, and detects the concentration of a specified component in the extracted oil obtained in this solvent extraction process, and at the same time, controls the extraction conditions according to these detected values, and thus the hydrorefining process in the stage after the solvent extraction process can be carried out under sufficiently mild conditions, not under severe conditions.

Therefore, due to being able to carry out the hydrogenation process under comparatively mild conditions, the simplification of the maintenance of the hydrogenation process, the decrease in operating cost, and long catalyst life of the hydrogenation process unit can be implemented. In addition, by suitably controlling this hydrogenation process, various types of oil products according to their objective and intermediate oil products can be flexibly produced.

In addition, if the concentration of the heptane insoluble component in the fraction of the extracted oil obtained in the solvent extraction process that cannot be fractionally distilled is defined by the concentration of the poly-aromatics in the fraction that cannot be fractionally distilled, continuous measurement thereof becomes possible, and therefore the process conditions of the hydrogenation process can be rapidly changed based on the measured results, and thereby carrying out the hydrogenation process at conditions that are more severe than necessary can be prevented.

In the refining facility for heavy oil that refines heavy oil to obtain refined oils, the refining facility for heavy oil of the present invention provides a solvent extraction process unit that obtains an extracted oil by the solvent extraction process and a hydrorefining process unit that subjects the obtained extracted oil to hydrogenation process in the presence of hydrogen and a catalyst and obtains a hydrorefined oil, and the solvent extraction process unit provides a detecting device that detects the concentration of the predetermined component in the extracted oil obtained by the solvent extraction process and a control device that controls the process conditions of the solvent extraction process according to the values obtained by the detecting device, and therefore the residue (heptane insoluble component) in the extracted oil can be defined by detecting, for example, the concentration of the poly-aromatics, and there by not only can the hydrogenation process be carried out under comparatively mild conditions, but of course, various types of oil products and intermediate oil products according to their object can be flexibly produced.

What is claimed is:

1. A refining method for refining heavy oil and obtaining a refined oil, comprising:

performing a solvent extraction step in which an extracted oil, which includes saturates, mono-aromatics, di-aromatics, tri-aromatics, poly-aromatics and a heptane insoluble component, is obtained by subjecting the heavy oil to a solvent extraction process using a solvent; and performing a hydrorefining step in which a hydrorefined oil is obtained by subjecting the obtained extracted oil to a hydrogenation process in the presence of hydrogen and a catalyst;

continuously maintaining the poly-aromatics concentration within the range of 26.8 wt % to 40.2 wt % and a ratio of the heptane insoluble concentration to the poly-aromatics concentration within the range of 0.140 to 0.152 in the extracted oil obtained by the solvent extraction step which maintains a deasphalted oil extraction rate within the range of 55 to 85% by means of an NIR analyzer or an NMR analyzer as the index of the concentration of heptane-insoluble components in the extracted oil;

based on correlation between the concentration of the heptane-insoluble components and the concentration of the poly-aromatics in the extracted oil, which is obtained in advance, comparing the detected poly-aromatics concentrations with a predetermined value of the poly-aromatic concentration; and according to the comparing result, continually controlling at least one of the extraction conditions selected from the extraction temperature and the flow rate of at least one of the solvent and the heavy oil in the solvent extraction step; and further continually controlling refining conditions of the hydrogenation refining step, thus producing a hydrorefined oil having a target concentration of the heptane-insoluble components.

2. A refining method for heavy oil according to claim 1 wherein the hydrorefining step controls at least one of the conditions selected from the LHSV (liquid hourly space velocity), the reaction temperature, and the hydrogen to oil ratio.

3. A refining method for heavy oil according to claim 1, wherein at least one part of the refined oil is a raw material for FCC (fluid catalytic cracking), and the control is carried out depending on the predetermined value of the poly-aromatic concentration at which the heptane insoluble component in the extracted oil corresponds to 5.5 wt %.

4. A refining facility for refining heavy oil and obtaining refined oil according to the steps of claim 3 comprising:

insoluble components.

5. A refining facility for heavy oil according to claim 4, wherein a comparing device stores a relationship between the concentrations of the heptane-insoluble component and the poly-aromatic in the extracted and refined oil, which is obtained in advance, and the predetermined value of the poly-aromatic concentration corresponding to the target concentration of the heptane-insoluble components.

6. A refining facility for a heavy oil according to claim 4, wherein a second control device controls at least one selected from the LHSV, the reaction temperature, or the hydrogen to oil ratio of the hydrogenation refining process unit, according to the value obtained by the detecting device.

7. A refining facility for a heavy oil according to claim 4 further comprising a storage tank that stores the extracted oil of which the concentration of the poly-aromatic components was detected.

* * * * *